US006332469B2

(12) United States Patent
Treskov et al.

(10) Patent No.: US 6,332,469 B2
(45) Date of Patent: Dec. 25, 2001

(54) SET OF IMPLEMENTS FOR SHAVING A BODY PART

(76) Inventors: Yakov Treskov; Erena Treskova, both of 2329 Hudson Ter., Apt. B5, Fort Lee, NJ (US) 07024

( * ) Notice: Subject to any disclaimer, the term of this patent is extended or adjusted under 35 U.S.C. 154(b) by 9 days.

(21) Appl. No.: 09/776,121

(22) Filed: Feb. 3, 2001

Related U.S. Application Data

(63) Continuation-in-part of application No. 09/401,224, filed on Sep. 22, 1999, now abandoned.

(51) Int. Cl.[7] ..... A45D 27/16; A45D 27/22; A45D 27/00

(52) U.S. Cl. ..... 132/290; 132/289; 132/292

(58) Field of Search ..... 132/290, 289, 132/292, 215; 30/34.05, 74, 41, 90

(56) References Cited

U.S. PATENT DOCUMENTS

| | | | | |
|---|---|---|---|---|
| D. 340,178 | | 10/1993 | Kashami | D8/91 |
| 3,031,757 | | 5/1962 | Kramer | 30/74 |
| 3,653,090 | | 4/1972 | Weaver | 15/105 |
| 4,083,102 | | 4/1978 | Harshberger | 30/45 |
| 4,615,436 | | 10/1986 | Hastie | 206/208 |
| 4,625,402 | * | 12/1986 | Kovaoussi | 30/41 |
| 5,329,699 | | 7/1994 | McCoy | 30/34.05 |
| 5,638,042 | | 6/1997 | McCoy | 335/306 |
| 5,738,624 | | 4/1998 | Zablotsky | 600/9 |
| 5,915,391 | | 6/1999 | Revil | 132/119.1 |

* cited by examiner

*Primary Examiner*—Gene Mancene
*Assistant Examiner*—Robyn Kieu Doan
(74) *Attorney, Agent, or Firm*—Boris Leschinsky

(57) ABSTRACT

A set of implements for shaving a body part capable of reducing skin irritation, preventing or promoting faster healing of skin cuts through delivering of a low frequency modulation magnetic field therapy. The set includes a shaving brush and a razor. The shaving brush includes a handle, magnetically conductive bristles, and a permanent magnet contained in the handle of the shaving brush. One set of ends of the bristles of the shaving brush are embedded in the permanent magnet, with the bristles extending axially therefrom and out through the handle of the shaving brush. The magnet forms a magnetic field directed towards the body part and oriented so the positive and of the magnet is directed also towards the body part. During application of shaving cream, repetitive motions by the user cause low frequency modulation of the magnetic field to be applied to the body part that possesses prophylactic and healing properties. The razor includes a handle, a blade cartridge, a razor blade, arid a plurality of bi-polar magnets positioned on the blade cartridge away from the cutting edge of the blade in a preferred configuration, the magnets are spaced apart so as not to interfere with one another and are oriented in parallel to cause a combined magnetic field to be directed towards the body part during shaving. It is preferred that the magnets are positioned on the razor to be in direct contact with the body part in order to deliver the magnetic therapy of maximum efficacy.

19 Claims, 1 Drawing Sheet

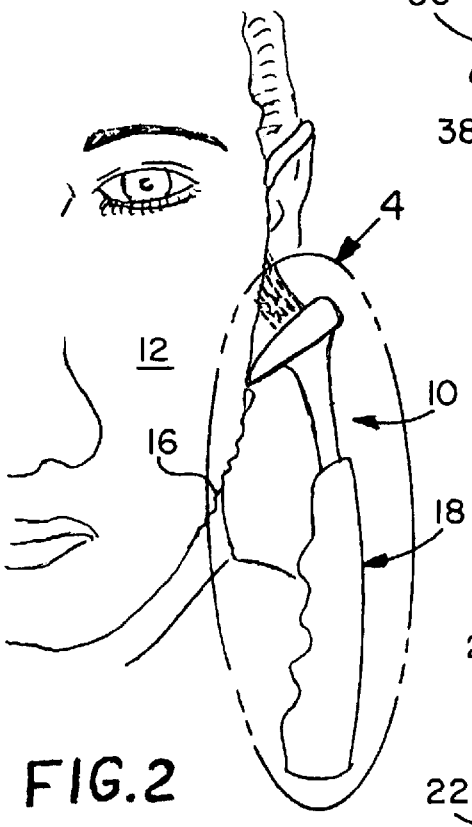
FIG.2
FIG.1
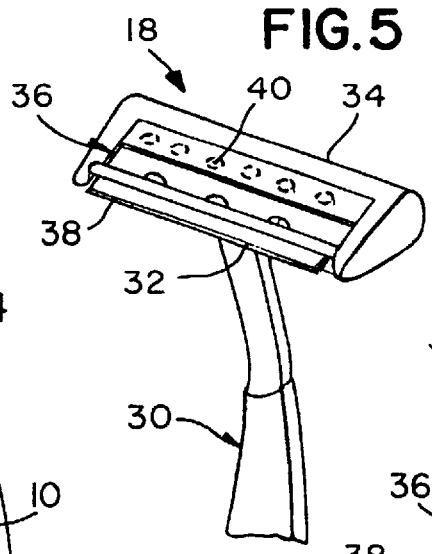
FIG.5
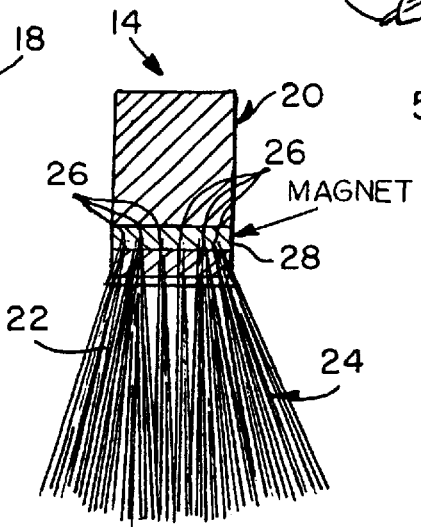
FIG.3
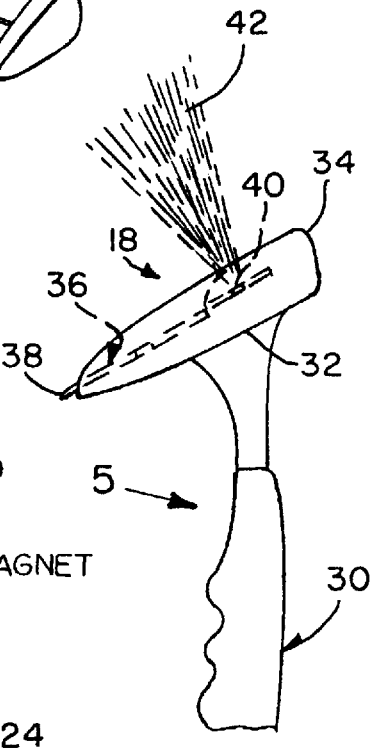
FIG.4
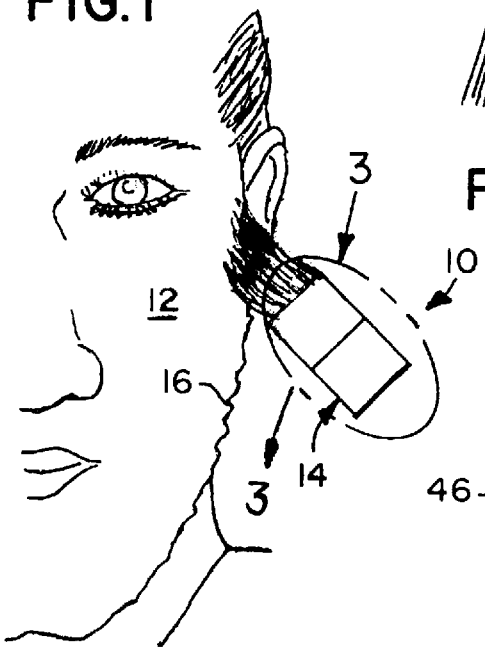
FIG.6
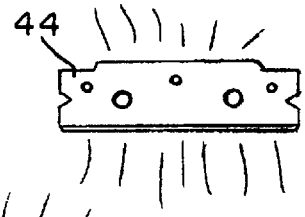
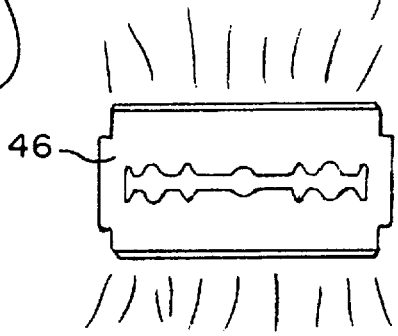
FIG.7

SET OF IMPLEMENTS FOR SHAVING A BODY PART

CROSS-REFERENCE DATA

This is a continuation-in-part of our U.S. patent application Ser. No. 09/401,224 filed Sep. 22, 1999, now abandoned.

BACKGROUND OF THE INVENTION

1. Field of the Invention

The present invention relates generally to a set of shaving implements. More particularly, the present invention relates to a razor with a razor blade equipped with permanent magnets to provide prophylactic and healing effects on the body part which is subject to shaving as well as extend the life of the razor blade. Another components of the set is the shaving brush also equipped with permanent magnets in the handle so that a similar healing effect from a permanent magnetic field is applied during the application of the shaving cream.

2. Description of the Prior Art

The use of permanent magnets in combination with a razor or a razor blade is known in the prior art. The main purpose of using a magnet is to maintain the sharpness of cutting edge of the blade. Earlier examples of such devices are described in the U.S. Pat. Nos. 1,775,518, 1,782,033, 2,792,108, and 2,321,570.

More recently, various razor holders have been proposed which are designed to accept a conventional disposable razor or a razor holding a disposable razor blade during storage. Examples of such devices can be found in the U.S. Pat. No. 4,615,436 by Hastie and U.S. Pat. No. 5,329,699 by McCoy. Typically, a holder is suggested containing one or several permanent magnets positioned in such a way that when a razor is stored in the holder, the magnets provide a magnetic field oriented in the plane parallel to that of the razor blade. Such arrangement is proposed to straighten micro-bends of the cutting edge of the blade so it remains sharp for a longer time.

Additional examples of the use of permanent magnets to extend the life of the blade can be found in the following U.S. Pat. No. : 4,083,102 by Harshberger; U.S. Pat. No. Des. 340,178 by Kashani; and U.S. Pat. No. 5,638,042 by McCoy.

Incorporating the magnets into the razor holders has one disadvantage, namely there is no direct contact between the magnet and the blade. U.S. Pat. No. 3,031,757 by Kramer improves this situation by incorporating a magnet into the razor head itself, in contact with the blade, and on the side opposite to the cutting edge. However, it still has the only function of maintaining the sharpness by aligning the magnet in such a way that the direction of the magnetic field is parallel with the plane of the blade.

Magnetic healing therapy has been known for a long time to provide prophylactic, pain relief, and general positive action onto a human body. The magnetic therapy practice has caused the development of products with permanent magnets distributed on the products. For example, U.S. Pat. No. 4,509,219 teaches a sleeping mattress structure provided with permanent magnets each having a magnetic field strength of at least 850 gauss which are disposed on the mattress for maximum magnetic curing effect. U.S. Pat. No. 4,921,560 teaches a method for fixing the permanent magnets to bed covering. Merchandise worn by humans having magnetic structure has also been developed. For example, Japan Life Products 1992 Catalog, at page 10 and 11, shows belts, elbow and knee supporters, wrist and foot support massager provided with magnetic structure. Similarly, OMS Medical Supplies 1992–93 Catalog, at pages 59–67, shows human wear merchandise provided with magnetic structure. The DMS merchandise includes head bands, vests, belts, wrist bands, supports for the elbows, arms, legs, knee and ankle, and also necklaces. Another example of such wearable items can be found in the U.S. Pat. No. 5,720,046 as well as in many others. The permanent magnets are commercially available in a variety of shapes and magnetic strengths, see for example OMS Medical Supplies 1992–93 Catalog, at pages 74–75. The user of the discrete permanent magnet has to generally tape the magnet onto the particular body point being treated.

An example of applying static magnets to the face using a malleable face mask with flat sheet magnetic inserts can be found in the U.S. Pat. No. 5,738,624 by Zablotsky.

Not all of the magnetic implements known in the prior art are capable of effective magnetic therapy. Some of them are placed in a static arrangement with the body, while others are designed to have a single body solid magnet. Without going into the details of magnetic therapy, one can generally state that to maximize the efficacy of such therapy, the magnets of the implement should:

be periodically moved adjacent to the body part;

be in a form of a plurality of magnets spaced apart from each other so as not to interfere and mutually reduce their individual magnetic fields; and preferably have a parallel orientation of the polarity of their magnetic fields, that towards the skin.

The act of shaving has a risk of creating skin cuts. Although magnets have been suggested to be used for maintaining blade sharpness, a factor critical in avoiding a skin cut, the risk of inadvertent cutting is still there. None of the razors of the prior art are capable of reducing the skin irritation and improving the safety of shaving. The need exist therefore for a shaving implement allowing to minimize the risks associated with a skin cut by providing general curing and prophylactic magnetic therapy action as well as promoting the healing of the skin.

The present invention suggests to maximize the effect of magnetic therapy as can be achieved by incorporating permanent magnets into all elements of the shaving implement, including a razor and a shaving brush.

Prior art brushes are typically magnetically passive and contain a simple handle with a plurality of magnetically passive ordinary bristles incorporated therein. Such brush is shown for example in the U.S. Pat. No. 3,653,090 by Weaver.

An example of the use of magnets in a similar item is shown in the U.S. Pat. No. 5,915,391 by Revil. An electric comb is discussed having an oscillatory motion capability due to a cam mechanism incorporated in the head of the comb. Return springs are used to retain individual teeth of the comb in contact with the cam. In one embodiment, a pair of permanent magnets of opposite polarity is used in place of the spring for the same purpose. This item does not provide any magnetic therapy effect due to inherent small sizes of the magnets and especially since each magnet in a pair is placed opposite the other so the overall magnetic field from a pair is effectively canceled out.

The need therefore exists for a set of shaving implements capable of improving on the prior art and namely capable of providing a healing and prophylactic effect without requiring the user to go beyond the normal shaving routine and therefore reduce the risk of skin cuts during shaving as well as improve the skin healing in case of a cut.

SUMMARY OF THE INVENTION

Accordingly, it is an object of the present invention to overcome these and other drawbacks of the prior art by providing a novel set of implements for shaving a body part capable of delivering magnetic therapy during shaving.

It is another object of the present invention to provide a shaving set incorporating permanent magnets in a razor and in a shaving brush.

It is a further object of the invention to provide a set of implements for shaving a body part capable of reducing skin irritation commonly associated with the act of shaving.

It is a further object of the present invention to provide a set of implements for shaving having the above advantages and being at the same time easy and inexpensive to manufacture.

It is yet a further object of the present invention to provide a set of shaving implements having all of the above advantages but at the same time not requiring from the user any additional time or efforts beyond that needed for an ordinary shaving.

The set of the invention contains a novel razor and a novel brush. The novel brush of the invention has a handle with a distal part equipped with a permanent magnet means adapted to allow imbedding of brush bristles therein. It may be a single magnet sintered in such a way as to include a number of wells needed for placement of bristles. Alternately, it can be a non-magnetic member made of appropriate polymer in the shape containing bristle wells and also containing a number of conventional permanent magnets. The polarity of the magnetic field created in this case is oriented towards the skin. The bristles are assembled to extend from the brush handle in a conventional way. They are optionally made of a magnetically conductive material to increase the propagation of the magnetic field from the brush handle towards the skin of a body part to be shaved. During application of a shaving cream, the use of a brush creates a massaging repetitive motion suitable for delivering of magnetic therapy by the brush to create prophylactic and healing effect.

To maximize the effects of magnetic therapy, the set also includes a novel razor. The razor of the invention (disposable or reusable) comprises a handle, a head, and at least one blade with at least one cutting edge, the blade being retained in the razor head. The razor head also includes at least one permanent magnet, and preferably a number of permanent magnets positioned in such a way as to provide a magnetic field oriented in a direction perpendicular to that of the plane of the blade. In a preferred configuration, the magnets are adapted to come in contact with the skin of the body part during the shaving process. The magnetic field created by the magnets of the razor is therefore capable of delivering a magnetic therapy during the act of shaving as well as, at least to some degree, of maintaining the sharpness of the blade.

Optionally, the razor blade itself (either single- or double-edged) can be made with a magnetic material and charged so that it creates the necessary magnetic field. In that case, it can be used with a conventional razor of any appropriate design.

BRIEF DESCRIPTION OF THE DRAWINGS

A more complete appreciation of the subject matter of the present invention and the various advantages thereof can be realized by reference to the following detailed description in which reference is made to the accompanying drawings in which:

FIG. 1 is a front elevation view of the shaving brush of the present invention in use;

FIG. 2 is a front elevation view of the razor of the invention in use;

FIG. 3 is an enlarged cross-sectional view of the brush of the invention taken along line 3—3 of FIG. 1;

FIG. 4 is an enlarged side elevation view of the area generally enclosed in the dotted line identified by arrow 4 in FIG. 2 of the razor of the invention;

FIG. 5 is a diagrammatic perspective view taken generally in the direction of arrow 5 in FIG. 4;

FIG. 6 is a diagrammatic top plan view of a single-edged magnetic razor blade for use in a conventional shaver; and finally FIG. 7 is a the same as in FIG. 6 but for a double-edged blade.

DETAILED DESCRIPTION OF THE PREFERRED EMBODIMENTS OF THE INVENTION

A detailed description of the present invention follows with reference to accompanying drawings in which like elements are indicated by like reference letters and numerals.

FIGS. 1 and 2 represent the overall illustration of use of the invention where the set of implements is generally designated as 10 and the body part as 12. The detailed description of the set now follows.

The set of implements 10 comprises a shaving brush 14 for applying shaving cream 16 to the body part 12 to be shaved, and a disposable razor 18 for removing the shaving cream 16 from the body part 12 being traversed.

The specific configuration of the shaving brush 14 can best be seen in FIG. 3, and as such, will be discussed with reference thereto.

The shaving brush 14 comprises a handle 20 for holding in an hand and has a distal end 22, and bristles 24 for applying the shaving cream 16 and which extend axially from the distal end 22 of the handle 20 of the shaving brush 14. Bristles 24 also have one set of ends 26 adapted for imbedding into a brush handle 20 using commonly known techniques. The shaving brush 14 further comprises a magnet 28 that is generally disk-shaped and is contained laterally in the handle 20 of the shaving brush 14, slightly displaced from the end 22 of the handle 20 of the shaving brush 14. The magnet 28 may be made as a solid permanent magnet using sintering or other known magnet producing techniques to contain wells adapted to receive the ends 26 of the bristles 24. Alternately (not shown on the drawings), the magnet 28 may be a disk-shaped body made of a non-magnetic material such as a polymer. In that case, however, a plurality of smaller spaced apart magnets may be imbedded in that disk-shaped body, preferably with the same orientation of polarity of the magnetic field directed towards the skin. A preferred orientation of that polarity when a positive "end" or charge of the magnet is directed towards the skin rather then the negative one. In that case, of course, provisions are made (such as wells) to accept the ends 26 of the bristles 24.

With one set of ends 26 of the bristles 24 of the shaving brush 14 being embedded in the magnet 28 of the shaving brush 14, the bristles 24 extend axially therefrom and out through the end 22 of the handle 20 of the shaving brush 14 so as to propagate a discrete magnetic field around the bristles 24 and towards the skin of the body part 12, while that field is believed to possess prophylactic and healing properties.

To further improve the efficacy of the magnetic field, it is suggested to make at least some if not all of the bristles 24 from a magnetically conductive material. One example of such a material is a composite material containing magnetic particles imbedded in a generally non-conductive carrier.

To further improve the efficacy of the set, a novel razor 18 is also proposed carrying a number of permanent magnets. The specific configuration of the razor 18 (disposable or reusable if so designed) can best be seen in FIGS. 4 and 5, and as such, will be discussed with reference thereto. The razor 18 comprises a handle 30 for holding in the hand and which has an end 32, and a blade cartridge 34 that extends transversely across the end 32 of the handle 30 of the razor 18.

The razor 18 further comprises a razor blade 36 that is disposed in the blade cartridge 34 and has a cutting edge 38 for removing the shaving cream 16. It shall be understood, that when referred to a blade 36, a combination of two or even three blades assembled in parallel, such as in modem disposable razors is also included in the discussion.

The razor 18 further comprises at least one or preferably several bi-polar magnets 40 placed opposite the cutting edge 38 of the blade 36. The magnets 40 are therefore in magnetic communication with the razor blade 36 so as to form a discrete magnetic field 42 on the razor blade 36 that possesses prophylactic and healing properties. In a particularly preferred configuration, a number of magnets 40 are spaced apart along the edge of the blade opposite the cutting edge 38 so that individual magnetic fields are aligned in parallel and towards the skin and do not interfere with each other. In that case, the orientation of such magnetic fields would be generally perpendicular to the plane of the blade 36. It is further preferred that each individual magnet is oriented with its positive side directed towards the skin of the body part 12 to be shaved. Generally, the more discrete magnets is placed on the cartridge 34, the better the efficiency of magnetic therapy. Of course, that number is practically limited by the dimensions of the razor. A preferred material for magnets 40 is neodimium rare earth magnet demonstrating a strong magnetic capacity while allowing for physically small size.

It is generally known that the efficacy of magnetic therapy depends on the frequency of its alternation and the number of magnets as illustrated by the following mathematical formula:

$$F=N\times\Omega,$$

where F is the frequency of magnetic field modulation, as measured in Hz; N is the number of magnets; and finally Ω is the frequency scanning or the frequency with which the magnets are moved in the vicinity of the skin, as also measured in Hz.

Ideally, low frequency modulation is best suited for effective magnetic therapy application. It is perfectly matched with the design of the present invention, in which the routine act of shaving creates repetitive motions with low frequency in the very near vicinity of the skin.

Further, it is preferred that in use the magnets 40 are capable of directly touching the skin of the body part 12 to be shaved. Commonly known provisions are envisioned in the design of the cartridge 34 to allow for that. One example (not shown) of numerous variations of such provisions is to offset the magnets 40 from the surface of the blade 38 so as to make is easy for the user to utilize the razor in a way when the magnets 40 are directly sliding against the skin.

In addition to the delivery of magnetic therapy which is the main objective of the invention, the presence of the magnets 40 will improve the longevity of the blade 38 as was described in the prior art patents. Although the orientation of the magnetic field perpendicular to the blade) is not optimal for that purpose, it is believed that the mere presence of the magnets 40 will tend to increase the life of the blade as compared with the razors not equipped with any magnets at all. In a preferred embodiment, magnets 40 are placed in direct contact with the blade 38. Although not necessary for delivering the magnetic therapy, it may further improve the sharpness of the blade 38.

During its routine use to remove the shaving creme 16 from the body part 12, the razor 18 of the invention demonstrates a unique ability to deliver shaving action, massaging action, and magnetically prophylactic and healing action all at the same time while preserving, at least to some degree, the sharpness of the blade 36.

Finally, as shown in FIGS. 6 and 7 for an alternative embodiment of the invention, a conventional disposable razor can be used with a magnetized single-edged blade 44 and a magnetized double-edged blade 46, respectively. Such arrangement has tile advantage of being amenable for use with all conventionally designed razors as well as it improves the contact between a highly magnetized part (a blade itself in this case) and a skin of the body part to be shaved. Razor designs incorporating more than one blade, such as those having two and even three blades, would be especially effective in providing magnetic therapy according to the invention. As before, it is preferred to magnetize the blades in such a way that the direction of the magnetic field is towards the skin for improved application of the magnetic therapy.

The set of shaving implements of the present invention is believed to be capable of reducing skin irritation as well as reducing the risks of skin cuts and even in case a cut occurs, promoting faster healing of the skin. All of the advantages can be realized without the need to change the daily shaving routine by an individual. In addition to delivering various curing and healing health effects when used on a healthy skin, the set of implements of the invention is believed to contribute positively to skin healing when used on a skin with various degrees of pathology.

Although the present invention has been described with respect to several specific embodiments and applications, it is not limited thereto. Numerous variations and modifications readily will be appreciated by those skilled in the art and are intended to be included within the scope of the present invention, which is recited in the following claims.

What we claim is:

1. A set of implements for shaving a body part, said set comprising:

a shaving brush for applying a shaving cream to the body part to be shaved, and a razor with a razor blade for removing the shaving cream from the body part being traversed, wherein at least one of either said brush or said razor being equipped with a permanent magnet means, said permanent magnet means comprising a plurality of individual bi-polar permanent magnets, said individual magnets spaced apart not to interfere with one another, said individual magnets oriented in parallel with one another, not in the plane of said razor blade, and in a direction towards said body part to form a magnetic field in said direction, said magnetic field possessing prophylactic and healing properties.

2. The set of implements as in claim 1, wherein said permanent magnet means further having a positive end, said permanent magnet means oriented so that said positive end is directed towards said body part.

3. The set of implements as in claim 1, wherein said shaving brush further comprising:

a brush handle for holding in a hand, said brush handle having a distal end, a plurality of bristles for applying the shaving cream, said bristles generally extending axially from said distal end of said brush handle, each of said bristles having an end, and said permanent magnet means being a disk-shaped permanent magnet contained laterally in said brush handle, said disk-shaped magnet adapted to retain said ends of said bristles so as to extend said magnetic field axially from said brush handle towards said body part.

4. The set of implements as in claim 3, wherein at least some of said bristles are made from a magnetically conductive material.

5. The set of implements as in claim 3, wherein said disk-shaped magnet further comprising a plurality of individual magnets.

6. The set of implements as in claim 1, wherein said razor further comprising:

a razor handle for holding in a hand, said razor handle having an end, a blade cartridge extending transversely across said end of said razor handle, said cartridge containing said permanent magnet means, wherein said razor blade disposed in said blade cartridge, said razor blade having a cutting edge for removing the shaving cream.

7. The set of implements as in claim 6, wherein said permanent magnet means being disposed in said cartridge away from said cutting edge of said razor blade.

8. The set of implements as in claim 6, wherein said permanent magnet means being oriented to cause said magnetic field in a direction generally perpendicular to that of said razor blade.

9. The set of implements as in claim 6, wherein said magnets being neodimium rare earth magnets.

10. The set of implements as in claim 6, wherein said permanent magnet means being in magnetic communication with said razor blade.

11. The set of implements as in claim 6, wherein said cartridge being adapted to provide for said permanent magnet means being in direct contact with said body part.

12. The set of implements as in claim 11, wherein said permanent magnet means being offset with respect to said razor blade.

13. The set of implements as in claim 1, wherein said razor being a single-edge blade.

14. The set of implements as in claim 1, wherein said razor being a double-edge blade.

15. A shaving brush for applying a shaving cream to a body part, said brush comprising:

a brush handle for holding in a hand, said brush handle having a distal end, a plurality of bristles for applying the shaving cream, said bristles generally extending axially from said distal end of said brush handle, each of said bristles having an end, and a disk-shaped permanent magnet means contained laterally in said brush handle, said pennanent magnet means oriented in a direction towards said body part to form a magnetic field in said direction, said magnetic field possessing prophylactic and healing properties, said permanent magnet means further adapted to retain said ends of said bristles to extend said magnetic field axially from said brush handle towards said body part.

16. The shaving brush as in claim 15, wherein at least some of said bristles are made from a magnetically conductive material.

17. The shaving brush as in claim 15, wherein said permanent magnet means further comprising a plurality of individual bi-polar permanent magnets, said individual magnets spaced apart not to interfere with one another, said individual magnets oriented in parallel with one another.

18. The shaving brush as in claim 15, wherein said permanent magnet means further having a positive end, said permanent magnet means oriented so that said positive end is directed towards said body part.

19. A razor for shaving a body part, said razor comprising:

a razor handle for holding in a hand, said razor handle having an end, a blade cartridge extending transversely across said end of said razor handle, said cartridge containing a permanent magnet means, said permanent magnet means including a plurality of individual bi-polar permanent magnets spaced apart so as not to interfere with one another, said individual magnets causing a plurality of magnetic fields to be oriented in parallel with one another, not in the plane of said blade cartridge, and directed towards said body part, said magnetic fields in combination possessing prophylactic and healing properties, and a razor blade disposed in said blade cartridge, said razor blade having a cutting edge opposite said permanent magnetic means.

* * * * *